US007488240B2

(12) United States Patent
Saito

(10) Patent No.: US 7,488,240 B2
(45) Date of Patent: Feb. 10, 2009

(54) POLISHING DEVICE

(75) Inventor: Toshiya Saito, Tokyo (JP)

(73) Assignee: Elpida Memory, Inc., Tokyo (JP)

( * ) Notice: Subject to any disclaimer, the term of this patent is extended or adjusted under 35 U.S.C. 154(b) by 0 days.

(21) Appl. No.: 11/798,524

(22) Filed: May 15, 2007

(65) Prior Publication Data

US 2007/0270089 A1 Nov. 22, 2007

(30) Foreign Application Priority Data

May 16, 2006 (JP) ..... 2006-136024

(51) Int. Cl.
*B24B 29/00* (2006.01)

(52) U.S. Cl. ..... 451/285; 451/287; 451/398

(58) Field of Classification Search ..... 451/41, 451/285, 287, 288, 397, 398
See application file for complete search history.

(56) References Cited

U.S. PATENT DOCUMENTS

| | | | | |
|---|---|---|---|---|
| 6,572,438 | B2 | 6/2003 | Numoto | |
| 6,585,850 | B1 * | 7/2003 | Kenji et al. | 156/345.12 |
| 6,746,318 | B2 * | 6/2004 | Mallery et al. | 451/285 |
| 7,063,604 | B2 * | 6/2006 | Spiegel | 451/285 |
| 7,311,586 | B2 * | 12/2007 | Maloney et al. | 451/41 |
| 2005/0124269 | A1 * | 6/2005 | Masunaga et al. | 451/285 |
| 2005/0153635 | A1 * | 7/2005 | Boo et al. | 451/285 |
| 2006/0128277 | A1 * | 6/2006 | Maloney et al. | 451/41 |
| 2006/0148382 | A1 * | 7/2006 | Hayama et al. | 451/8 |
| 2006/0199479 | A1 * | 9/2006 | Togawa et al. | 451/59 |

FOREIGN PATENT DOCUMENTS

| | | |
|---|---|---|
| JP | 03-138933 | 6/1991 |
| JP | 05-069310 | 3/1993 |
| JP | 2001-212754 A | 8/2001 |
| JP | 2001-367941 A | 12/2002 |
| JP | 2004-119495 A | 4/2004 |

* cited by examiner

*Primary Examiner*—Eileen P. Morgan
(74) *Attorney, Agent, or Firm*—Foley & Lardner LLP

(57) ABSTRACT

A polishing device includes a polishing pad for polishing a wafer and a polishing head for holding the wafer. The polishing head has a retainer ring for retaining the wafer in the in-plane direction of the wafer, a membrane sheet for pressing the wafer against the polishing pad, and a head body for supporting the retainer ring and the membrane sheet. The retainer ring has a subordinate retainer member having a ring portion and a plurality of fins extending from the ring portion to retain the peripheral surface of the wafer. The subordinate retainer member has a thickness equal to the thickness of the wafer. The membrane sheet has a diameter larger than the wafer, and presses the wafer and the vicinity of the inner edge of the subordinate retainer member.

9 Claims, 5 Drawing Sheets

POLISHING DEVICE

This application is based upon and claims the benefit of priority from Japanese patent application No. 2006-136024 filed on May 16, 2006, the disclosure of which is incorporated herein in its entirety by reference.

BACKGROUND OF THE INVENTION

1. Field of the Invention

The present invention relates to a polishing device. In particular, the present invention relates to a polishing device for use in a chemical-mechanical-polishing (CMP) process in manufacturing a semiconductor device.

2. Description of the Related Art

In recent years, since the density for integration of a semiconductor device has been increased, the number of interconnection layers in a multilayer interconnection structure is increased in the semiconductor device. In a photolithographic process for the semiconductor device having the multilayer interconnection structure, the uniformity of the film surface exposed by an exposure system should correspond to the range of focal depth of the light source used in the exposure system. Thus, the technique for planarization of the film surface has become more and more important. A CMP process is adopted as one of the planarization processes.

FIG. 7 shows an example of a polishing device used in the CMP process. The polishing device, generally designated at numeral 100, includes a polishing pad 11 having a circular polishing surface 11*a* for polishing the main surface of a target wafer 12. A polishing head 13 is disposed to oppose the polishing surface 11*a* with the wafer 12 being interposed therebetween. The polishing head 13 includes a head body 14 having a disc-like shape, a membrane sheet 17 disposed on the head body 14 to be in contact with the rear surface of the wafer 12, and a retainer ring 16 disposed to encircle the membrane sheet 17 and wafer 12 for retention of the same. A closed space 18 is formed between the bottom surface of the head body 14 and the membrane sheet 17. High-pressure air is supplied into the closed space 18 to thereby expand the membrane sheet 17, which presses the wafer 12 against the polishing pad 11.

The top surface of the retainer ring 16 is fixed onto the bottom surface of the head body 14, whereas the bottom surface of the retainer ring 16 abuts the polishing surface 11*a* of the polishing pad 11. FIG. 8 is a top plan view showing the positional relationship between the retainer ring 16 and the wafer 12. The retainer ring 16 is of an annular shape, and the inner edge of the retainer ring 16 abuts the periphery of the wafer 12 to retain the wafer 12 in the in-plane direction thereof.

During polishing the wafer 12, the polishing pad 11 is rotated about the center thereof, while slurry (abrasive) is supplied onto the central position of the polishing surface 11*a*. The membrane sheet 17 presses the rear surface of the wafer 12 retained inside the retainer ring 16, whereby the main surface of the wafer 12 is pressed against the polishing surface 11*a*. In this state, the polishing head 13 is rotated about the central axis thereof and reciprocated in the radial direction of the polishing surface 11*a*. Thus, the CMP processing for the main surface of the wafer 12 is carried out.

Patent Publications JP-2004-119495A and JP-2002-367941A, for example, describe a CMP apparatus such as the polishing device shown in FIG. 7. The inventor analyzed the function and defect of the conventional polishing device 100, as detailed below.

In the polishing device 100 shown in FIG. 7, the periphery of the membrane sheet 17 is substantially aligned with the periphery of the wafer 12. In this structure, when the high-pressure air is supplied into the closed space 18 for polishing the wafer 12, the membrane sheet 17 is deformed to have a convex shape as viewed in the downward direction. FIG. 9 shows the structure of the peripheral portion of the membrane sheet 17 and wafer 12 during the polishing. The vicinity of the periphery of the membrane sheet 17 is slightly lifted away from the rear surface of the wafer 12, thereby preventing a sufficient pressure from being applied onto the periphery of the wafer 12. The insufficient downward pressure in the peripheral area leads to lowering of the polishing rate and causing an insufficient within-wafer uniformity in the wafer 12 after the polishing process, thereby degrading the product yield of the resultant semiconductor devices.

SUMMARY OF THE INVENTION

In view of the above, it is an object of the present invention to provide a polishing device capable of preventing the reduction of the polishing rate to improve the within-wafer uniformity of the polishing device by preventing occurrence of an insufficient downward pressure in the vicinity of the periphery of the wafer.

The present invention provides a polishing device including: a polishing pad for polishing a wafer; and a polishing head for holding the wafer, the polishing head including a retainer ring for retaining the wafer in an in-plane direction of the wafer, a membrane sheet for pressing the wafer against the polishing pad, and a head body for supporting the retainer ring and the membrane sheet, wherein: the retainer ring includes a first retainer member having an inner edge for retaining a peripheral surface of the wafer and having a thickness substantially equal to a thickness of the wafer, and a second retainer member for supporting a peripheral portion of the first retainer member; and the membrane sheet has a diameter larger than a diameter of the wafer and presses the inner edge of the first retainer member in addition to the wafer.

The above and other objects, features and advantages of the present invention will be more apparent from the following description, referring to the accompanying drawings.

DETAILED DESCRIPTION OF EMBODIMENTS

Figure 1:
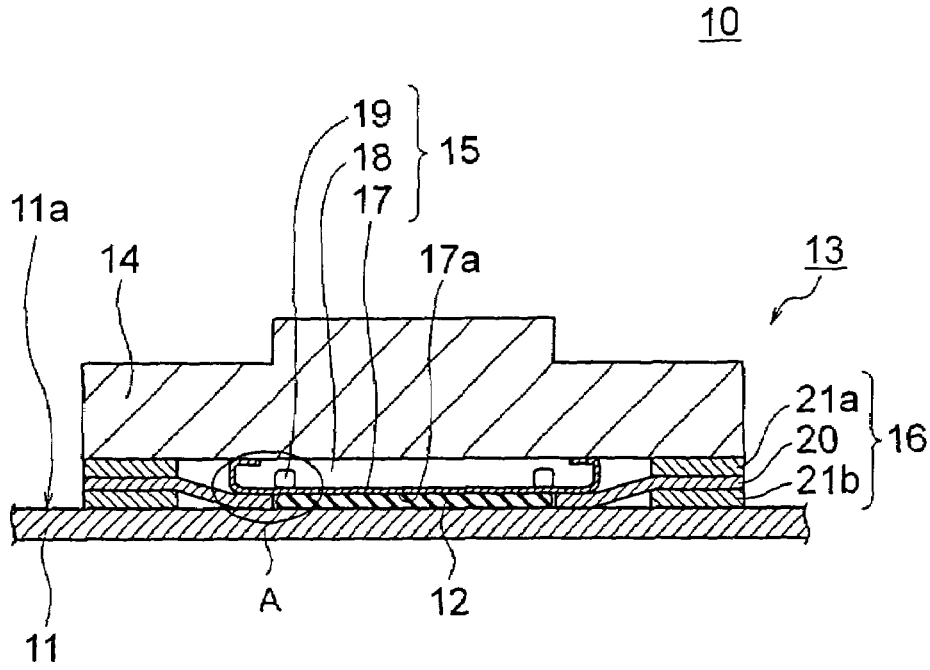
FIG. 1 is a sectional view showing the configuration of a polishing device according to an exemplary embodiment of the present invention.

Now, an exemplary embodiment of the resent invention will be described with reference to accompanying drawings, wherein similar constituent elements are designated by similar reference numerals throughout the drawings.

FIG. 1 shows the polishing device of the exemplary embodiment, generally designated at numeral 10, for use in a CMP process in a semiconductor device manufacturing process. The polishing device 10 includes a polishing pad 11, which includes a circular polishing surface 11*a* and is rotated about the center thereof. The polishing pad 11 is made of polyurethane, and has thereon a plurality of grooves (not shown) used for polishing the wafer 12.

The tip portion of a tube (not shown) for supplying therethrough slurry is supported on the polishing pad 11 such that the slurry is supplied onto the center of the polishing surface 11*a*. The polishing device 100 includes a polishing head 13 opposing the polishing surface 11*a* with the wafer 12 being sandwiched therebetween. The polishing head 13 includes a head body 14, a pressing unit 15 disposed on the bottom surface of the head body 14 for pressing the wafer 12 against the polishing surface 11*a*, and a retainer ring 16 encircling the pressing unit 15 and wafer 12. The head body 14 has a disc-like shape. The retainer ring 16 retains the wafer 12 in the in-plane direction thereof.

The pressing unit 15 includes a membrane sheet 17 having a circular bottom surface in contact with the rear surface of the wafer 12. The periphery of the membrane sheet 17 has a U-character shape in section. The top edge portion of the membrane sheet 17 is fixed onto the bottom surface of the head body 14, and thus defines a closed space 18 between the membrane sheet 17 and the bottom surface of the head body 14. The closed space 18 is communicated with a first air supply port for supplying therethrough high-pressure air. By adjusting the pressure in the closed space 18 via the first air supply port, the downward pressure for pressing the rear surface of the wafer 12 is adjusted. The membrane sheet 17 has a circular pressing surface 17*a* having a larger diameter than the wafer 12, whereby the periphery of the pressing surface 17*a* protrudes from the periphery of the wafer 12. The membrane sheet 17 is made of, for example, Neoprene (registered trademark).

The pressing unit 15 further includes a torus pressing member 19 disposed in the closed space 18 to press the peripheral portion of the membrane sheet 17 toward the vicinity of the periphery of the wafer 12. The internal space of the torus pressing member 19 is communicated with a second air supply port for supplying therethrough high-pressure air. By adjusting the internal pressure of the torus pressing member 19, a downward pressure for pressing the vicinity of the periphery of the wafer 12 is adjusted. Due to the structure of the pressing unit 15, the vicinity of the periphery of the wafer 12 is applied with a pressure from the first air supply port and from the second air supply port.

The retainer ring 16 includes a subordinate retainer ring (first retainer member) 20 for retaining the wafer 12 and a second retainer member including an upper retainer body 21*a* and a lower retainer body 21*b* having a ring shape and sandwiching therebetween the outer periphery of the subordinate retainer ring 19. The subordinate retainer ring 19 has an inner edge interposed between the pressing surface 17*a* of the membrane sheet 17 and the polishing surface 11*a* of the polishing pad 11. The outer peripheral portion of the subordinate retainer ring 20 is interposed between the upper retainer body 21*a* and the lower retainer body 21*b* and fixed thereto by using, for example, adhesive. The subordinate retainer ring 20 has a thickness substantially equivalent to the thickness of the wafer 12. The inner edge of the subordinate retainer ring 20 abuts the peripheral surface of the wafer 12, whereby the wafer 12 is retained in the in-plane direction thereof.

Figure 2:
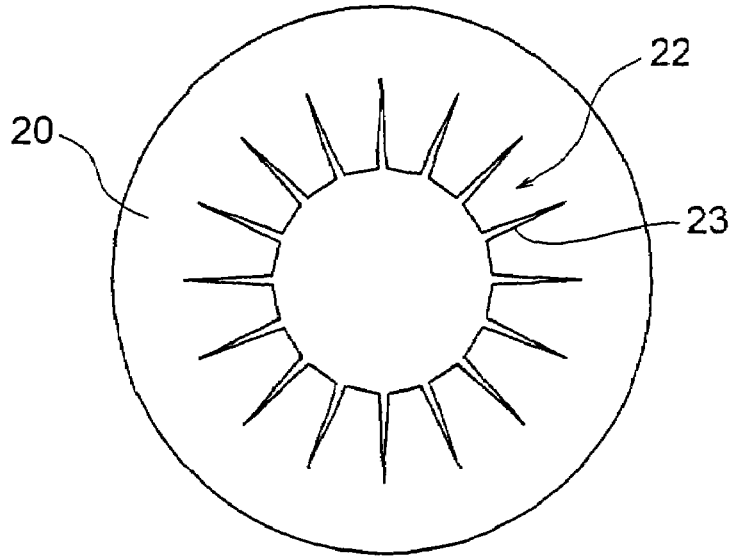
FIG. 2 is a top plan view showing the outer shape of the subordinate retainer ring shown in FIG. 1.
Figure 3:
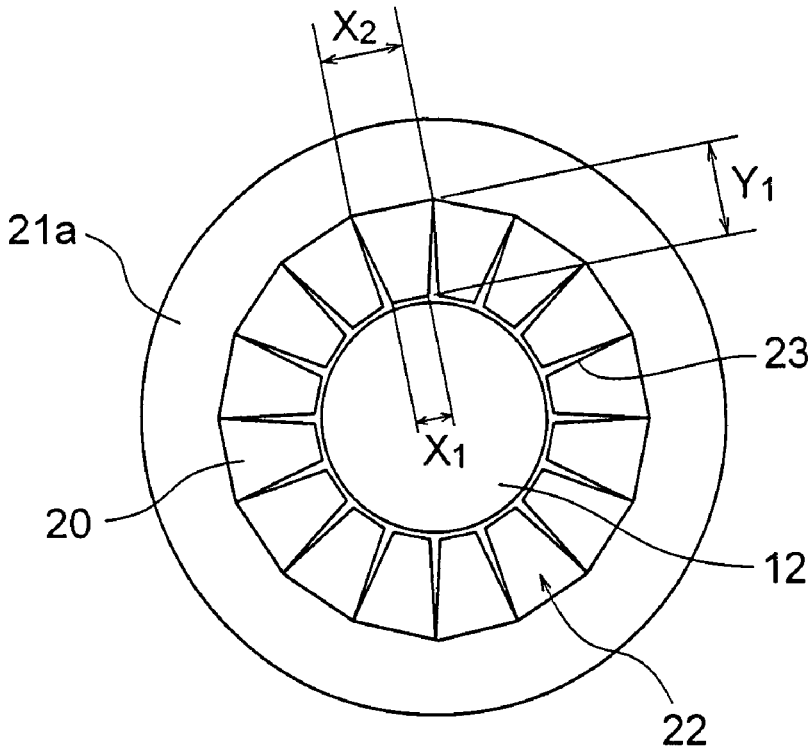
FIG. 3 is a top plan view showing the positional relationship among the subordinate retainer ring, the upper retainer body, and the wafer shown in FIG. 1.

FIG. 2 is a top plan view of the subordinate retainer ring 20, and FIG. 3 is a top plan view showing the positional relationship among the subordinate retainer ring 20, the upper retainer body 21*a*, and the wafer 12. The lower retainer body 21*b* has a shape similar to the shape of the upper retainer body 21*a*. The subordinate retainer ring 20 includes a ring portion inserted between the upper retainer body 21*a* and the lower retainer body 21*b*, and a plurality of trapezoidal fins 22 extending from the ring portion toward the peripheral surface of the wafer 12. A triangle gap or notch 23 is formed between each adjacent two of the fins 22. The triangle notch 23 allows the fins 22 to be curved or bent in the vertical direction by the pressing force applied from the membrane sheet 17 without interference between the fins 22.

In FIG. 3, the fins 22 have dimensions such that, for example, the top side of the trapezoid is $X_1$=52 mm, the bottom side thereof is $X_2$=63 mm, and the height is $Y_1$=15 mm. The subordinate retainer ring 20 and the retainer bodies 21*a* and 21*b* are made of, for example, polyphenylene sulfide (PPS) or polyether-ether ketone (PEEK).

Figure 4:
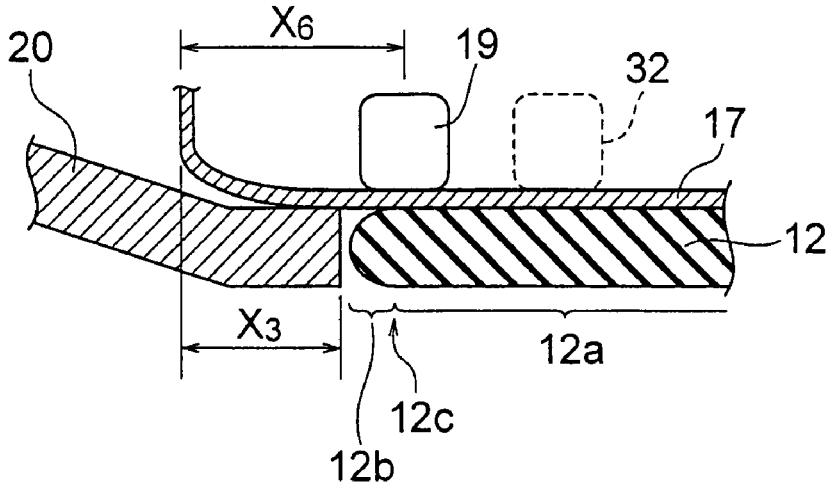
FIG. 4 is an enlarged sectional view of the vicinity of the membrane sheet denoted at "A" in FIG. 1.

FIG. 4 is an enlarged sectional view showing the portion denoted at "A" in FIG. 1. In an exemplified configuration of the present embodiment, the distance $X_3$ between the periphery of the membrane sheet 17 and the peripheral surface of the wafer 12 is set at 10 mm, and the distance $X_6$ between the periphery of the membrane sheet 17 and the center between the inner edge and outer periphery of the torus pressing member 19 is set at 15 mm. In other words, the distance $X_6$ is set at the value such that a support member (not shown) for supporting the torus pressing member 19 is not in contact with the outer periphery of the membrane sheet 17. As depicted in FIG. 4, the torus pressing member 19 is positioned at the boundary 12*c* between the flat portion 12*a* of the wafer 12 and the round peripheral portion 12*b* of the wafer 12.

Figure 7:
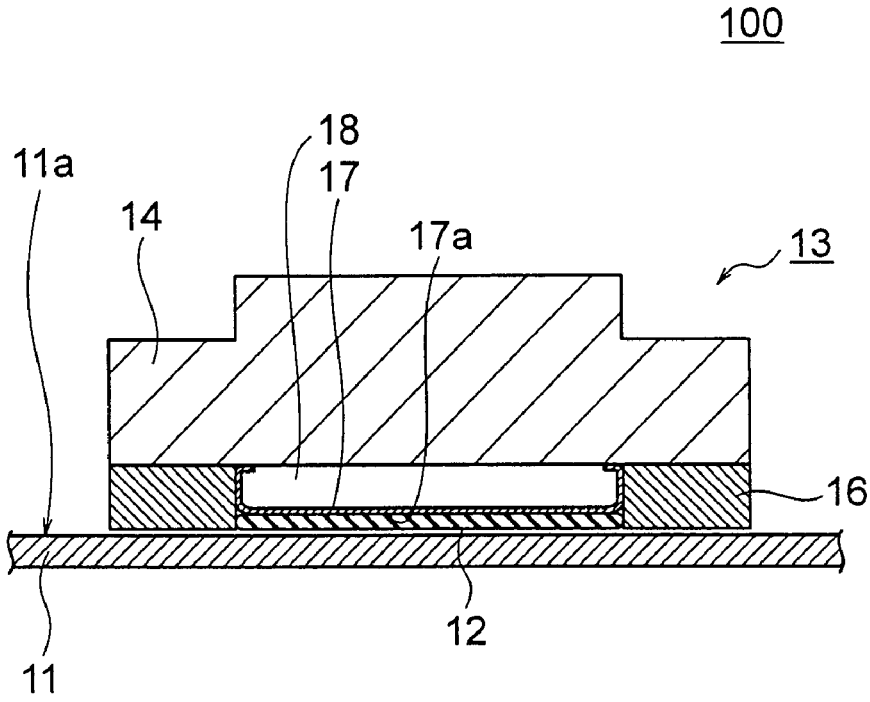
FIG. 7 is a sectional view showing the configuration of a conventional polishing device.
Figure 8:
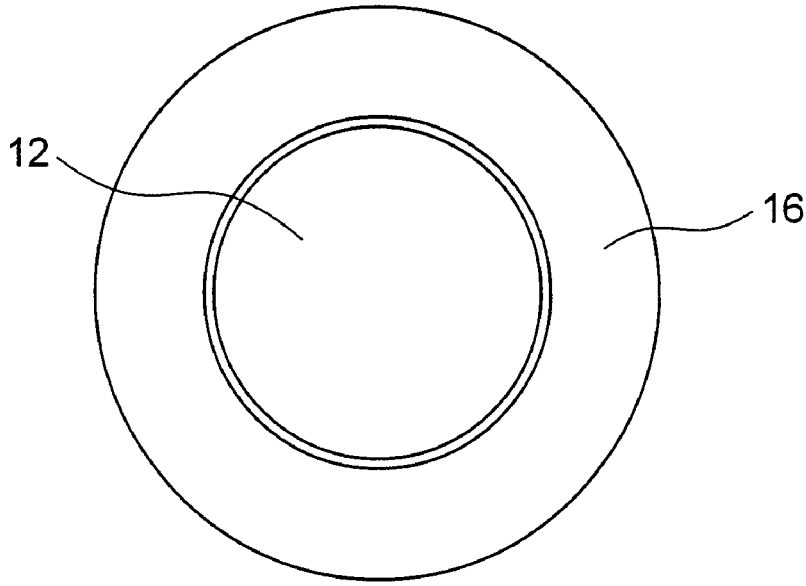
FIG. 8 is a top plan view showing the positional relationship between the retainer ring and the wafer shown in FIG. 7.
Figure 9:
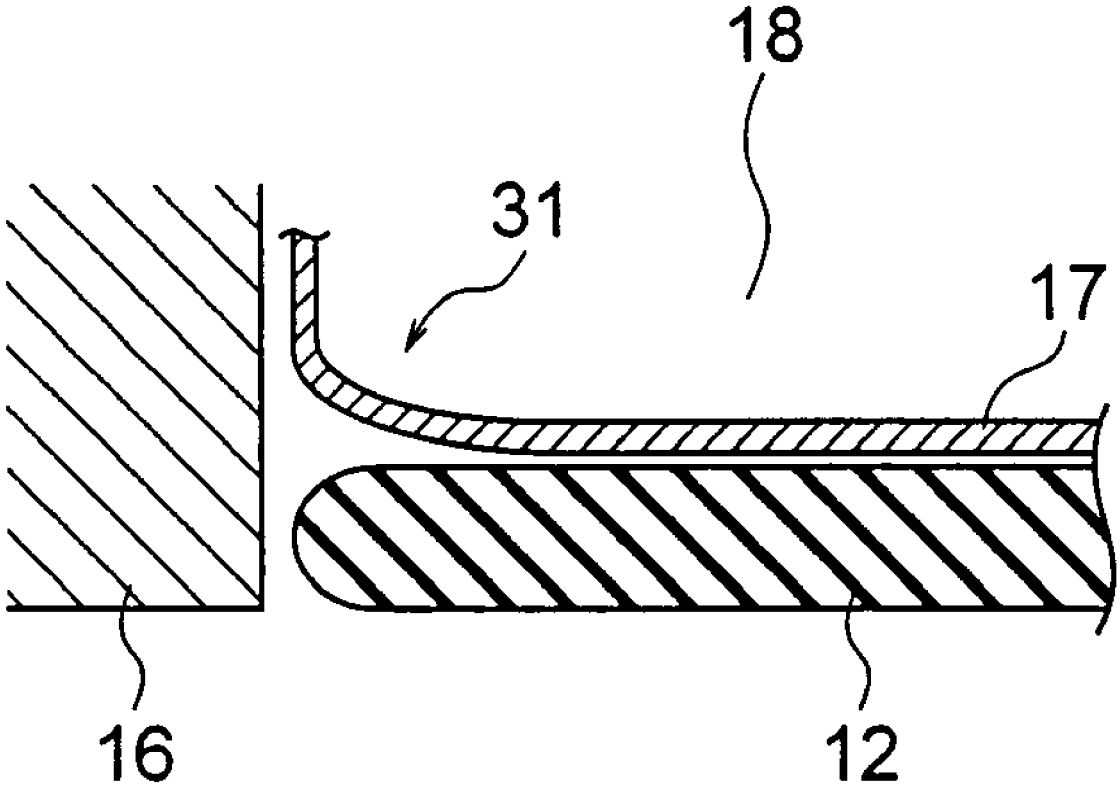
FIG. 9 is a sectional view of the vicinity of the periphery of the wafer shown in FIG. 7.

In the conventional polishing device 100 shown in FIG. 7, the periphery of the membrane sheet 17 is aligned with the periphery of the wafer 12. Therefore, if the torus pressing member 19 is to be disposed in the conventional polishing device 100, the torus pressing member 19 is arranged at a position deviated from the boundary 12*c* of the wafer 12, as shown by a dotted line 32 in FIG. 4. This position of the torus pressing member 32 will not be able to effectively press the boundary 12*c* or peripheral portion of the wafer 12.

On the other hand, in the polishing device 10 according to the present embodiment, the periphery of the membrane sheet 17 is located at a radially outside position away from the periphery of the wafer 12. Therefore, the torus pressing member 19 can be located in the vicinity of the periphery of the wafer 12, and thus can effectively press the peripheral portion of the wafer 12.

Back to FIG. 1, during polishing the wafer 12, the polishing pad 11 is rotated about the center of the polishing surface 11*a* at a rotational speed of 30 $min^{-1}$, for example, and slurry is supplied onto the central portion of the polishing surface 11*a* through the slurry supplying tube at a flow rate of 300 ml/min. (milliliters per minute). The slurry supplied to the central portion of the polishing surface 11*a* is then diffused toward the entire surface of the polishing surface 11*a* due to the rotation of the polishing pad 11.

In the state where the wafer 12 is retained inside the subordinate retainer ring 20 and the head body 14 is mechanically pressed onto the polishing pad 11 with a load $F_1$, the entire surface of the wafer 12 and the top surface of the subordinate retainer ring 20 are pressed with a load $F_2$ which is smaller than the load $F_1$, by means of the pressure from the first air supply port. In addition, the vicinity of the peripheral surface of the wafer 12 is further pressed with a load $F_3$ by the torus pressing member 19, and the downward pressure to the vicinity of the periphery of the wafer 12 is adjusted or controlled. The load $F_1$, is set at, for example, 70N (Newton), the load $F_2$ is set at, for example, 50N, and the load $F_3$ is adjusted in a range, for example, between 45N and 55N, so as to improve the uniformity of the vicinity of the periphery of the wafer 12 by the control of the load $F_2$. Thereby, the pressure applied onto the wafer 12 is be uniform in the in-plane direction of the wafer 12.

In the above polishing process, the polishing head 13 is rotated about the central axis thereof at a rotational speed of 29 $min.^{-1}$ and also reciprocally moved in the radial direction of the polishing pad 11 within the radial range thereof, thereby performing the CMP polishing of the main surface of the wafer 12. The wafer 12 is polished for a predetermined time interval selected in advance, and then washed by using a cleaning solution such as $NH_4OH$ in a washing device, which is driven in association with the polishing device 10. After removing the washed wafer, another wafer 12 is placed on the polishing device 10, and the another wafer 12 is polished under the similar condition. During polishing the wafers 12, the membrane sheet 17 and the subordinate retainer ring 20 are retained such that the pressing surface 17*a* of the membrane sheet 17 and the top surface of the inner edge of the subordinate retainer ring 20 abut each other at the location radially outside the wafer 12.

In the above configuration, the periphery of the membrane sheet 17 is positioned radially outside the periphery the wafer 12. This allows the vicinity of the periphery of the membrane sheet 17 to be lifted during polishing the wafer 12, without causing an insufficient downward pressure applied onto the vicinity of the periphery of the wafer 12. The torus pressing member 19 arranged at the boundary 12*c* between the flat portion 12*a* of the wafer 12 and the peripheral portion 12*b* of the wafer 12 effectively presses the vicinity of the periphery of the wafer 12. In this manner, the downward pressure applied to the peripheral portion of the wafer 12 is controlled by the torus pressing member 19*a*, whereby the reduction in the polishing rate or an insufficient polished amount in the vicinity of the periphery of the wafer 12 can be avoided.

The inventor manufactured the conventional polishing device 100 shown in FIG. 7 and the polishing device 10 of the above embodiment, for performing polishing of the wafer 12 by using these polishing devices. In the conventional polishing device 100, the torus pressing member 19 is additionally provided, as shown by the dotted line 32 in FIG. 4. The results of the polishing process by using these polishing devices revealed that the polishing rate of the polishing device 10 of the above embodiment is increased between the periphery of the wafer 12 and a position $X_6$=15 mm apart from the periphery of the wafer 12 (FIG. 4), as compared with the conventional polishing device 100.

In addition, the controllability of the polishing rate is also significantly increased in the above embodiment. The range of variation in the polished amount on the main surface of the wafer 12 was as large as ±10% in the conventional polishing device 100, whereas the range of variation in the polished in the polishing device 10 of the embodiment was decreased down to around ±5%. It was thus confirmed that the within-wafer uniformity of the polished wafer 12 is significantly improved by using the polishing device 10 of the embodiment.

Figure 5:
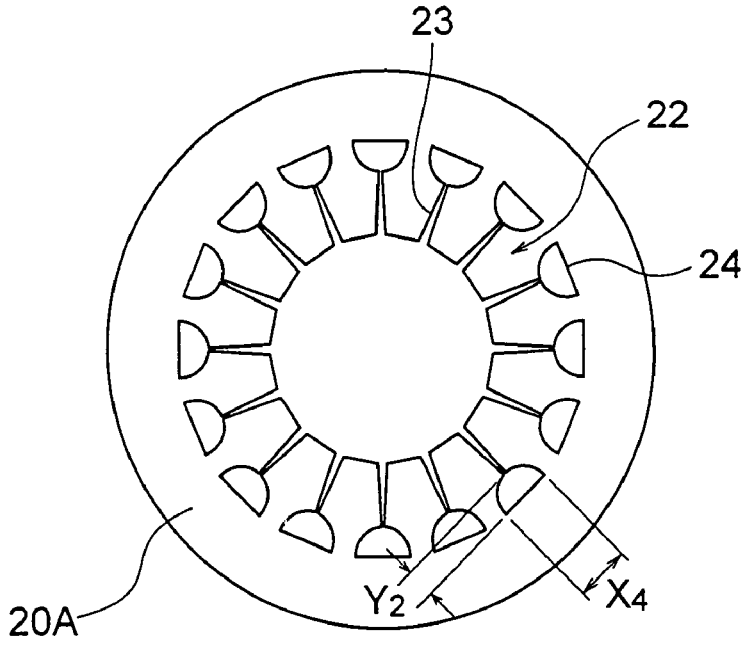
FIG. 5 is a top plan view showing the outer shape of the subordinate retainer ring in a polishing device according to a first modification of the above embodiment.
Figure 6:
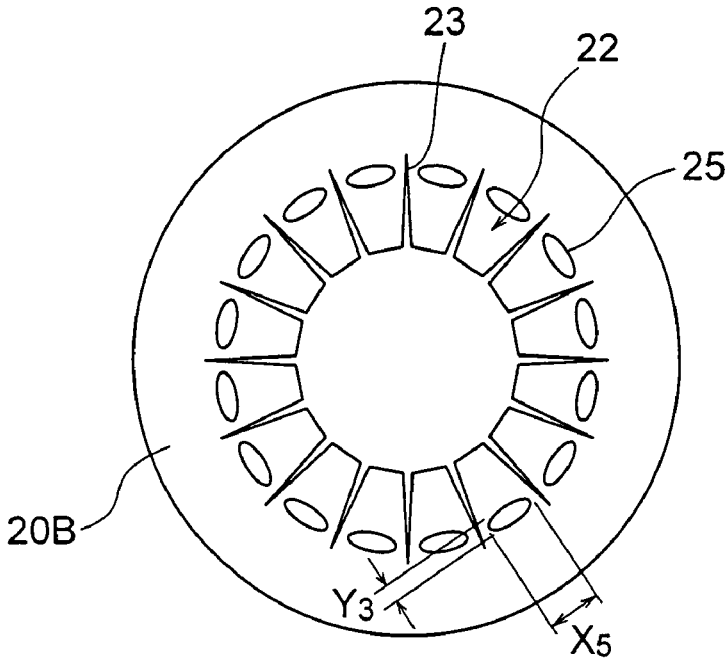
FIG. 6 is a top plan view showing the outer shape of the subordinate retainer ring in a polishing device according to a second modification of the above embodiment.

FIGS. 5 and 6 are top plan views showing the configuration of the subordinate retainer ring in polishing devices according to first and second modifications from the above embodiment. In the first modification, the subordinate retainer ring 20A has an additional notch 24 of a semi-elliptical shape formed at the gap between each adjacent fins 22. The additional notch 24 extends from the notch 23 which defines the gap between the adjacent fins 22. The additional notch 24 is located at the position nearer to the center of the subordinate retainer ring 20 than the inner edge of the retainer bodies 21*a* and 21*b*. In the second modification, the subordinate retainer ring 20B has an additional notch 25 of an elliptical shape disposed in each fin 22, i.e., between each adjacent two of the notches 23. The additional notch 25 is disposed near the retainer bodies 21*a* and 21*b*.

In FIG. 5, the dimensions of the additional notch 24 are, for example, such that the major axis of the ellipse is $X_4$=20 mm and half the minor axis thereof is $Y_2$=4 mm. In FIG. 6, the dimensions of the additional notch 25 are, for example, such that the major axis of the ellipse is $X_5$=30 mm, and the minor axis thereof is $Y_3$=4 mm.

In the polishing process for polishing the wafer 12, washing of the polishing head 13 is generally performed after each of the wafers 12 is polished. However, during washing the polishing head 13, it is important to prevent the slurry from remaining on the fins 22. The slurry remaining on the fins 22 will generate particles after the drying of the wafer 12. The particles may form a scratch on the surface of the wafer 12, or may become a foreign substance in the semiconductor device. In consideration of this problem, the polishing devices according to the first and second modifications include the additional notches 24 and 25, respectively, which are formed near the base of the fins 22 where the flow of the cleaning solution is likely to be disrupted. These modifications improve the fluidity of the cleaning solution near the base of the fins 22. In this manner, the modifications prevent occurrence of the residual substance on the fins 22 caused by the slurry.

As described in the polishing device of the exemplified embodiment of the present invention, the subordinate retainer ring 20 having an inner edge pressed by the membrane sheet 17 together with the peripheral portion of the wafer 12 improves the uniformity of the pressing force applied to the wafer, whereby the reduction in the polishing rate is avoided and thus the within-wafer uniformity of the polished wafer is improved.

While the invention has been particularly shown and described with reference to exemplary embodiment and modifications thereof, the invention is not limited to these embodiment and modifications. It will be understood by those of ordinary skill in the art that various changes in form and details be made therein without departing from the spirit and scope of the present invention as defined in the claims.

What is claimed is:

1. A polishing device comprising:

a polishing pad for polishing a wafer; and a polishing head for holding the wafer, said polishing head including a retainer ring for retaining the wafer in an in-plane direction of the wafer, a membrane sheet for pressing the wafer against said polishing pad, and a head body for supporting said retainer ring and said membrane sheet, wherein:

said retainer ring includes a first retainer member having an inner edge for retaining a peripheral surface of the wafer and having a thickness substantially equal to a thickness of the wafer, and a second retainer member for supporting a peripheral portion of said first retainer member; and said membrane sheet has a diameter larger than a diameter of the wafer and presses said inner edge of said first retainer member in addition to the wafer.

2. The polishing device according to claim 1, wherein said second retainer member is sandwiched between said head body and said membrane sheet.

3. The polishing device according to claim 1, wherein said first retainer member includes ring portion supported by said second retainer member and a plurality of fins extending from said ring portion in a radially inward direction to configure said inner edge.

4. The polishing device according to claim 3, wherein said first retainer member includes therein a plurality of notches.

5. The polishing device according to claim 1, wherein said first retainer member includes therein a plurality of notches.

6. The polishing device according to claim 1, wherein said membrane sheet and said head body define a closed space communicated with an air supply member.

7. The polishing device according to claim 6, further comprising a pressing member disposed in said closed space for pressing said membrane sheet toward the wafer.

8. The polishing device according to claim 7, wherein said pressing member is configured as a torus member having an internal space communicated with the air supply member.

9. The polishing device according to claim 8, wherein said internal space of said torus member has a controlled pressure.

* * * * *